US005119962A

United States Patent [19]

Vercillo et al.

[11] Patent Number: 5,119,962

[45] Date of Patent: Jun. 9, 1992

[54] CLOSURE BUTTON/PANEL ENERGY ENHANCEMENT

[75] Inventors: Peter A. Vercillo, Hinsdale; Joseph J. Janisch, Jr., Arlington Heights; Anthony J. Pfeiffer, Chicago, all of Ill.

[73] Assignee: Continental White Cap, Inc., Downers Grove, Ill.

[21] Appl. No.: 597,879

[22] Filed: Oct. 12, 1990

[51] Int. Cl.[5] ..... B65D 41/04

[52] U.S. Cl. ..... 215/230; 215/270; 215/271

[58] Field of Search ..... 215/230, 262, 270, 271, 215/318

[56] References Cited

U.S. PATENT DOCUMENTS

| | | | |
|---|---|---|---|
| 933,347 | 9/1909 | Schmitt | 215/271 |
| 3,062,396 | 11/1962 | Foss et al. | 215/271 |
| 3,160,302 | 2/1964 | Chaplin | 215/271 |
| 4,533,059 | 8/1985 | Kapolas et al. | 215/230 |
| 4,552,279 | 11/1985 | Mueller et al. | 215/318 |
| 4,603,786 | 8/1986 | Lecinski, Jr. et al. | 215/318 |
| 4,616,761 | 10/1986 | Nolan | 215/271 |
| 4,678,082 | 7/1987 | Fillmore | 215/230 X |
| 4,721,219 | 1/1988 | Dullabaun et al. | 215/274 |
| 4,957,211 | 9/1990 | Ekkert et al. | 215/230 |
| 5,016,769 | 5/1991 | Heilman | 215/230 |

*Primary Examiner*—Stephen Marcus
*Assistant Examiner*—Vanessa Caretto
*Attorney, Agent, or Firm*—Lockwood, Alex, FitzGibbon & Cummings

[57] ABSTRACT

This relates to a closure cap having an end panel which is equipped with a central button or panel area so as to cause deflection, either by way of a vacuum within an associated container or by mechanical action when a container is closed. Recently, there has been developed a desire for a louder popping noise when the closure is removed. Also there has been developed tamper indicating indicia elements to be actuated by the button or panel area to irreversibly indicate that a container has been opened even though the closure cap has been reapplied. A need for a greater stored energy in the button or panel area has been found and such additional stored energy is obtained by utilizing faceted areas or portions.

32 Claims, 6 Drawing Sheets

FIG. 15
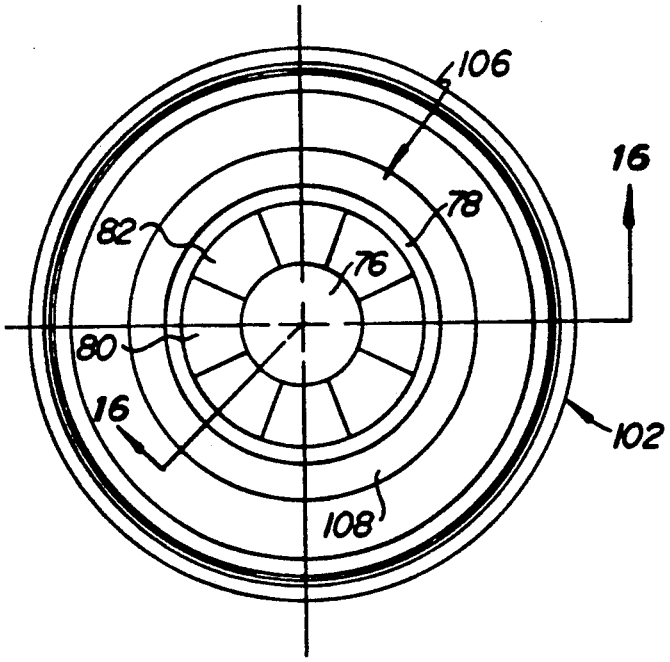
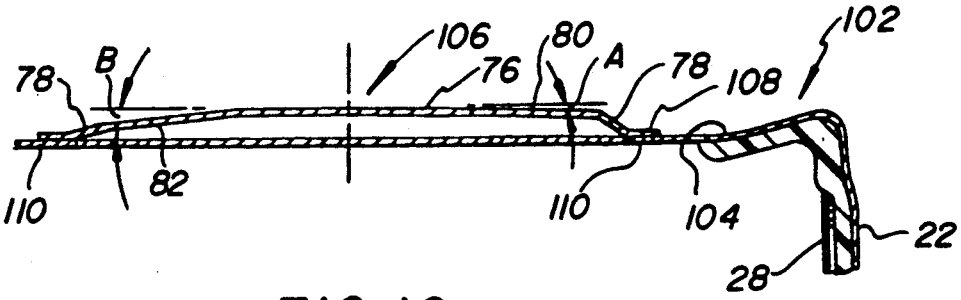
FIG. 16
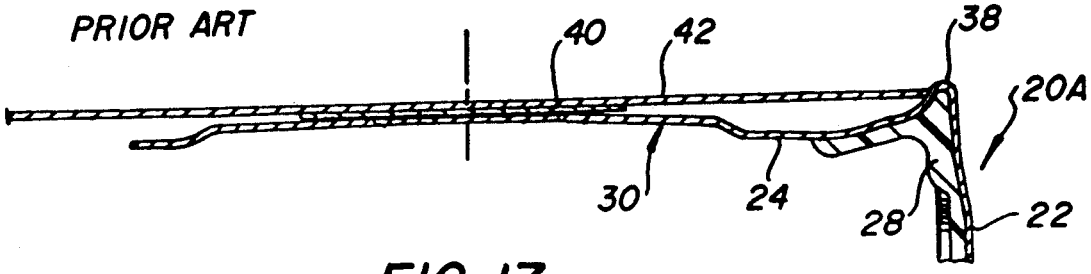
FIG. 17

CLOSURE BUTTON/PANEL ENERGY ENHANCEMENT

This invention relates in general to new and useful improvements in closures having built in tamper indicating means in the form of deflectable buttons or panel areas which deform depending upon the particular condition of closing of a container by such closure caps. Most particularly, this invention relates to a change in the structural shape of a closure button or panel area so as to enhance the energy stored therein and to greatly increase the same.

BACKGROUND OF THE INVENTION

Vacuum indicating buttons on closures are used extensively for the food industry because they are an effective quick-detection means that lets one know some very important conditions about the container. For example: Is the container sealed? - button is in "down" position; has the container been opened, or tampered? - button is in "up" position; has the seal been broken because of other causes, such as: severe handling, slow leakage or cracked glass at the seal area that could result in product spoilage. It is also very reasurring to hear the button "pop" as the closure is twisted off of the container. In addition, the button is an invaluable quality control means at the product filling operation. With automatic type detection equipment it lets the packer know, instantly, whether to accept the sealed container (button down), or reject it (button up), because a seal was not attained. Moreover, the vacuum indicating button on a closure has greatly increased in usage as a tamper indicating means in recent years.

Further, in more recent years, the position of the button and the "pop" noise made thereby when a container is opened, have not been the only usage. More recently, it has been proposed to utilize the movement of the button or other panel area of a closure to provide for a permanent indication of container opening. For example, it has been proposed to provide a frangible or brittle type coating that can be irreversibly fractured by the movement of a panel portion (button) that may, for example, provide a color change to indicate that a container is either presently opened or has been previously opened and reclosed.

SUMMARY OF INVENTION

In accordance with this invention, it is proposed to modify the panel area, such as a button, of a closure so that more flip energy is stored within the panel area so as to provide the necessary drive action or to produce a louder "pop". It has been found that by increasing the number of edges (corners) one can provide additional drive. Faceting can also increase the visual effectiveness of a holographic type image if used at the button/panel region, either in a convex or concave design depending whether it is for vacuum or pressure application, or neither.

With the above and other objects in view that will hereinafter appear, the nature of the invention will be more clearly understood by reference to the following detailed description, the appended claims, and the several views illustrated in the accompanying drawings.

FIG. 15 is a top plan view of a closure cap wherein the faceted panel arrangement is formed separate from the closure cap end panel.

FIG. 16 is an enlarged fragmentary transverse vertical sectional view taken generally along the line 16—16 of FIG. 15 and shows more specifically the construction of the panel.

FIG. 17 is a transverse vertical sectional view taken through a conventional button type closure cap wherein the closure cap is provided with indicia for permanently indicating removal of the closure cap even if the closure cap is returned.

DESCRIPTION OF PRIOR ART

Figure 1:
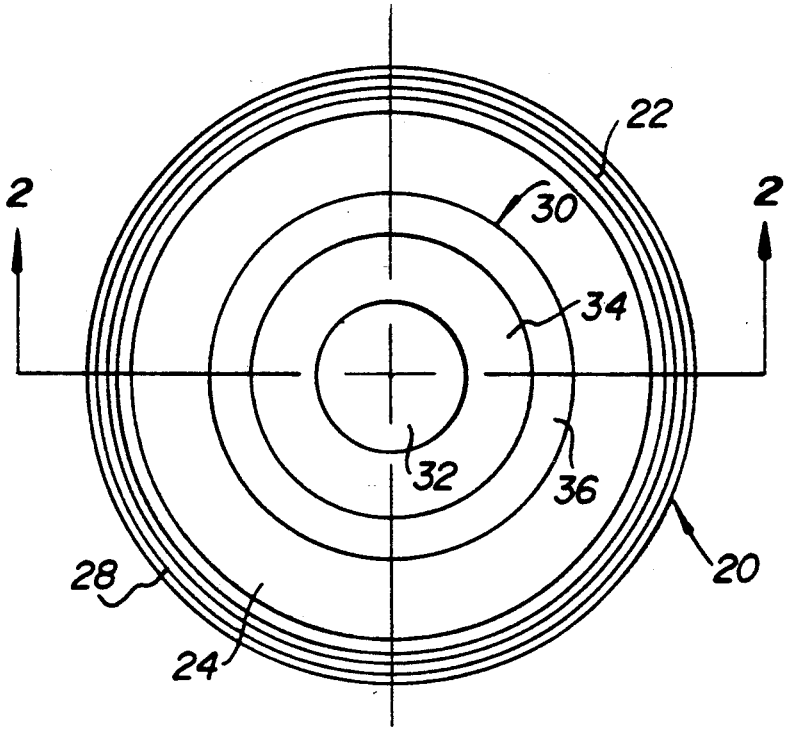
FIG. 1 PRIOR ART
FIG. 1 is a top plan view of a conventional PRIOR ART closure cap having an end panel with a button formation therein.
Figure 2:
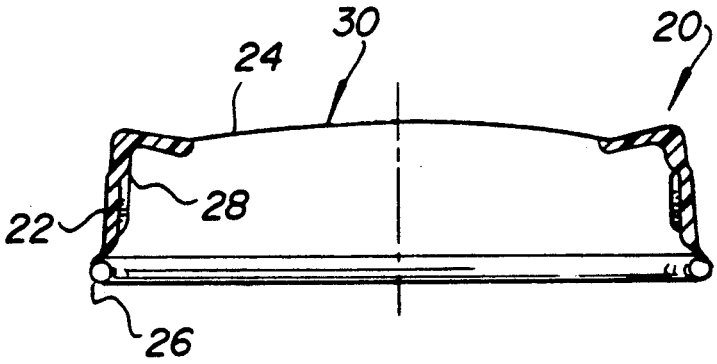
FIG. 2 PRIOR ART
FIG. 2 is a further prior art showing in the form of a vertical sectional view of the closure cap of FIG. 1 taken generally along the line 2—2 of FIG. 1.

Referring now to FIGS. 1 and 2, it will be seen that there is illustrated a closure cap which is generally illustrated by the numeral 20. The closure cap 20 is preferably formed of metal and includes a generally cylindrical skirt 22 depending from an end panel 24. The skirt 22 terminates in an inwardly directed curl 26 and is lined by a sealing compound 28 which also underlies the outer periphery of the end panel 24. The illustrated closure cap 20 is intended to be pressed on to a container having a threaded neck finish with the sealing compound 28 forming threads to facilitate the removal of the closure cap 20.

Further, the closure cap 20 is primarily intended to be utilized in conjunction with a container which is to be vacuum filled. In order to indicate that a vacuum exists within the sealed package, the end panel 24 includes a central button generally identified by the numeral 30. The button 30, as is best shown in FIG. 1, includes a central circular part 32, an intermediate annular part 34 and an outer sloping part 36. As is best shown in FIG. 2, in the initially manufacutred state of the closure cap 20, the button 30 is upwardly directed. However, when the closure cap 20 is applied to a container in a vacuum packing condition, the vacuum within the container draws the button 30 downwardly to indicate a sealed condition. A closure cap such as the closure cap 20 has been in use for a period of years. However, it provides only visual evidence that a vacuum exists within an associated container.

Reference is now made to FIG. 17 wherein a slightly modified form of closure cap, identified by the numeral 20A, is illustrated. The closure cap 20A is of the same general construction as to the closure cap 20 and includes an end panel 24 and a depending skirt 22 with there being a sealing compound 28 for forming both a threaded connnection and a top seal with a container neck finish. Further, the end panel 24 is provided with a central button 30.

The closure cap 20A differs from the closure cap 20 in that there is an upstanding peripheral rib 38 at the junction between the end panel 24 and the skirt 22. Further, the button 30 carries a layer of brittle or frangible material 40 which underlies a panel 42 which extends within and is generally seated on the rib 38. Generally the brittle material 40 is carried by the button 30 although it may be carried by the panel 42. The operation of the closure cap 28 is that when the button 30 is drawn down by a vacuum, and the vacuum is released, such as may occur when the closure cap is removed from a vacuum packed container, the button 30, due to stored energy therein, snaps upwardly and operates to fracture the brittle material 40. This results in permanent evidence that the closure cap 20A has been removed from a container even if the closure cap 20A is again placed on the container under vacuum conditions.

As will be described in more detail hereinafter, it is also feasible to utilize closure caps similar to the arrangement of the closure cap 20A wherein an equivalent button 30 is normally in a depressed position and is mechanically forced upwardly when the closure cap is applied.

This invention most particuarly relates to a modification of the general button area of a closure cap so as to increase the flip energy of such closure cap. With respect to the closure cap 20 which is typically used for the Baby Food Industry, it has been found that if a 0.312" diameter (2.030 gm) steel ball bearing is placed in the center of a down-flipped button and the vacuum is released, the height that the ball bearing travels is an indication of the flip energy. It has been found that with a typical commercial 48mm cap with a normal container vacuum of 23"-25" Hg the ball bearing flips to a height to approximately 1". A much higher flip energy is desired and in accordance with this invention, the flip energy of a like closure cap may be increased to flip the same ball bearing to heights of 6"-11". In addition, the button noise is increased in accordance with this invention. Button noise of a conventional commercial type button typically ranges from 124-128 dba whereas in accordance with this invention, button noise may be increased to typically range from 137-139 dba.

FIRST EMBODIMENT OF INVENTION

Figure 3:
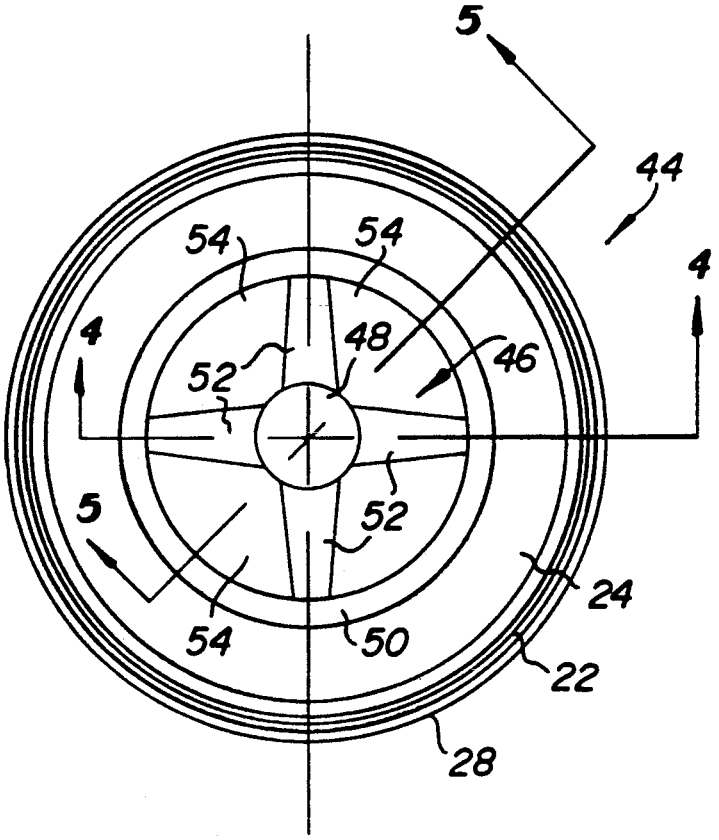
FIG. 3 is a plan view of a modified form of button type closure cap with high energy storage utilizing a number of corners or facets in accordance with the invention.
Figure 4:
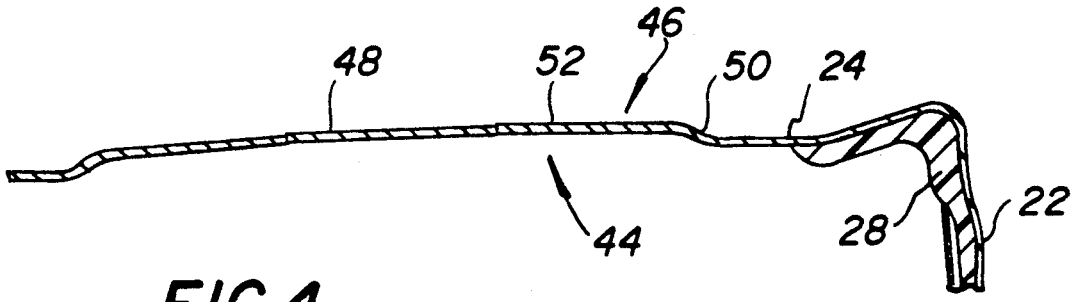
FIG. 4 is a fragmentary enlarged vertical sectional view taken generally along the line 4—4 of FIG. 3.
Figure 5:
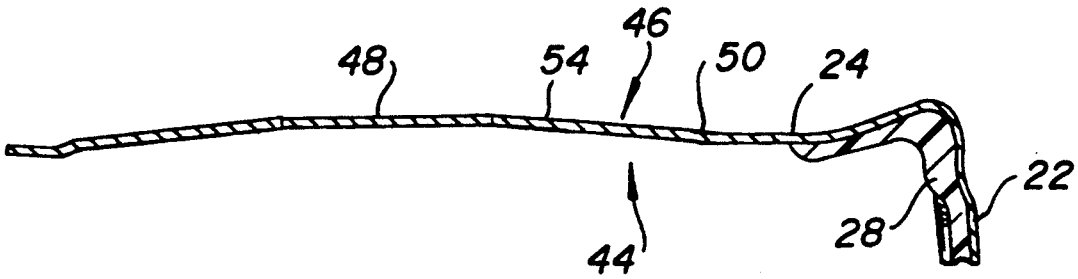
FIG. 5 is another fragmentary enlarged vertical sectional view through the closure cap of FIG. 3, but taken along the line 5—5 of FIG. 3.

Having specifically set forth the purpose of this invention, reference is now first made to FIGS. 3-5 wherein there is illustrated a modified closure cap, formed in accordance with this invention, which is generally identified by the numeral 44. The closure cap 44 is of a similar construction to the closure cap 20 and includes an end panel 24, a depending skirt 22 and a terminal curl 26. The skirt 22 and the peripheral portion of the end panel 24 are lined with a sealing compound 28.

The closure cap 44 differs from the closure cap 20 in the configuration of a central button or panel area 46.

The button or panel area 46 includes a circular central uppermost part 48 and is outlined by a generally sloping outer annular part 50. In the illustrated embodiment of the button or panel area 46, there are four radially extending parts 52 which present the same cross section as in the case of the button 30. These are shown in FIG. 4.

In order to increase the flip energy of the button or panel area 46 over that of the button 30, between the parts 52 are faceted parts or portions 54 the cross section of which is best illustrated in FIG. 5.

The above described button or panel area 46 may be identified as being of the "propeller" type with the illustrated embodiment being a four "propeller" type. Different numbers of faceted areas 54 are feasible although it has been found that the four facet panel type is most feasible from a manufacturing standpoint.

Figure 6:
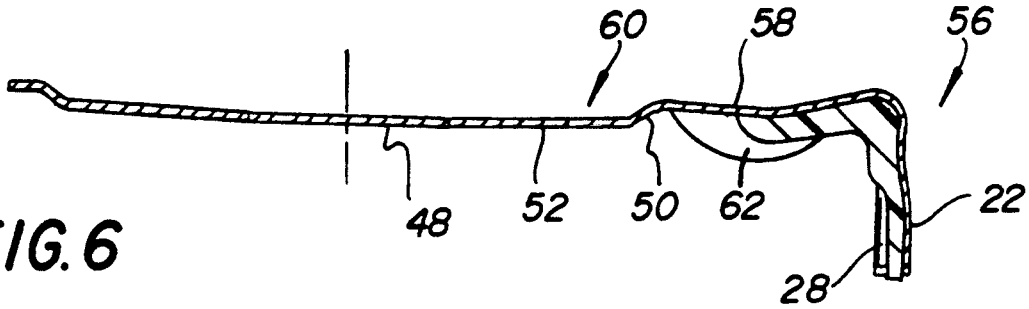
FIG. 6 is a transverse vertical sectional view similar to FIG. 4 but wherein the panel configuration is inverted from that of FIG. 4 and is mechanically actuated.
Figure 7:
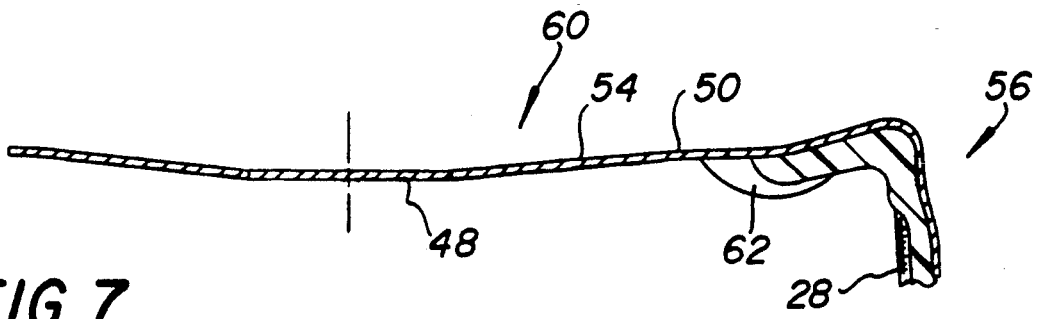
FIG. 7 is an enlarged fragmentary vertical sectional view similar to FIG. 5 of the inverted panel configuration.

While the closure cap 44 is of the vacuum actuated type, the principles of the closure cap 44 may be utilized in a closure cap wherein the button or panel area is mechanically actuated. Such a closure cap, generally identified by the numeral 56, is illustrated in section in FIG. 6 and 7 with these figures corresponding to FIGS. 4 and 5, respectively. The closure cap 56 will have a peripheral construction corresponding to that of the closure caps 20 and 44 but will have an end panel 58 of a modified construction. In lieu of the upstanding button or panel area 46 of the closure cap 44, the closure cap 56 will have a depressed button or panel area generally identified by the numeral 60. The button or panel area 60 will be of the same outline and cross section as the button or panel area 46 except that it will be inverted. Accordingly, like numerals will be applied to the various areas of the button or panel areas 60 as applied to the button or panel area 46.

The button or panel area 60 will, however, be mechanically actuated by suitable mechanical means. One known type of mechanical actuator is to provide a plurality of depending buttons or actuators 62 about the periphery of the end panel 58 for engagement with the end finish (not shown) of a container. When the closure cap 56 is applied to a container, the button 62 will be flattened which will cause the button or panel area 60 to snap upwardly. When the closure cap 56 is removed, the button or panel area 60 will return to its original position.

While the closure cap 56 has been illustrated as having a sealing compound for forming a threaded interlock with a container neck finish, it is pointed out here that it may be desirable that the skirt 22 be formed with shaped threads so that the closure cap 56, instead of being pressed on to a container, will be threaded on to such a container.

Figure 8:
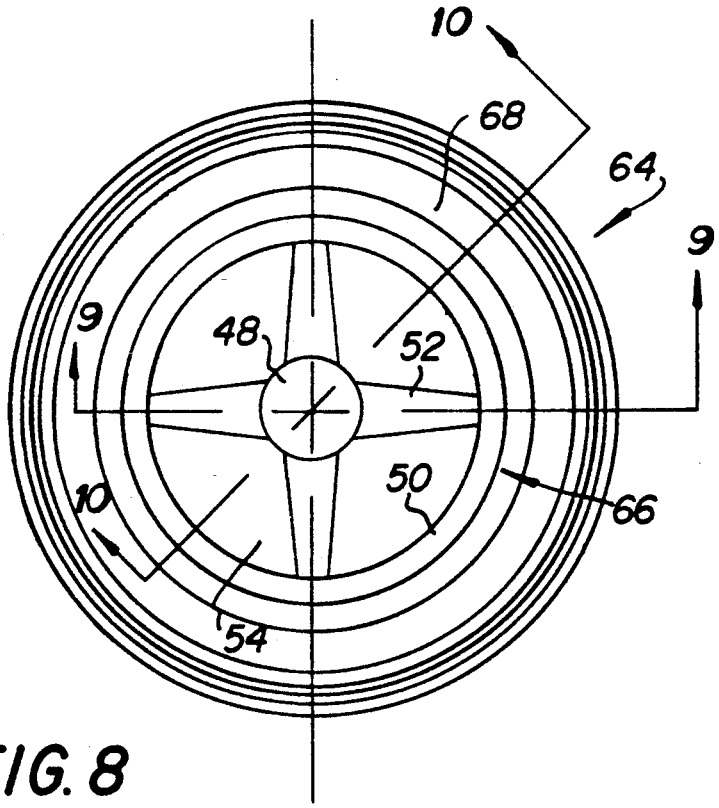
FIG. 8 is a top plan view of another type of closure wherein the energy storage construction is formed in a separate panel which is suitably bonded to a central part of an end panel of the closure cap.
Figure 9:
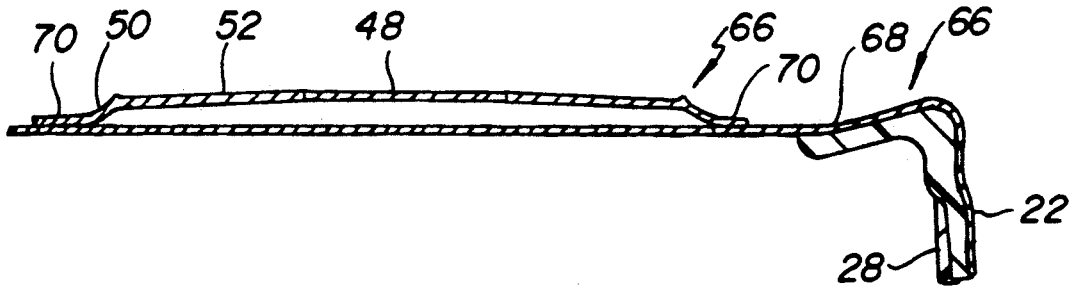
FIG. 9 is an enlarged fragmentary vertical sectional view taken generally along the line 9—9 of FIG. 8 and shows the separate mounting of the panel and the panel configuration area.
Figure 10:
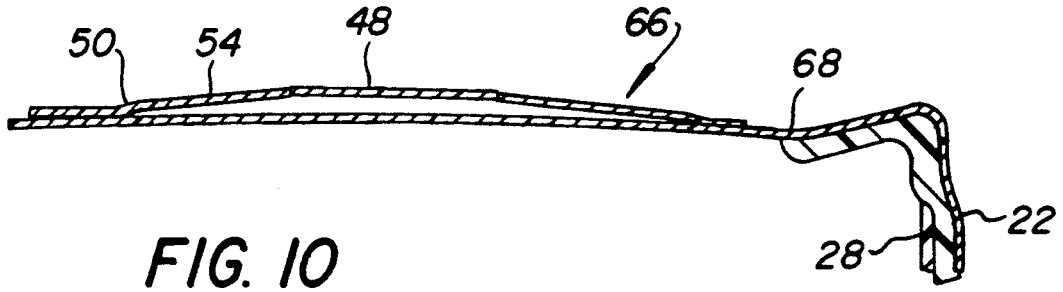
FIG. 10 is an enlarged fragmentary vertical sectional view similar to FIG. 9 and taken generally along the line 10—10 of FIG. 8 and shows a faceted cross section.

Referring now to FIGS. 8-10, it will be seen that there is illustrated still another form of closure cap employing the "propeller" type of button or panel area, this closure cap being generally identified by the numeral 64. The closure cap 64 will incorporate a separately formed button or panel area generally identified by the numeral 66 which will be of the same configuration as the button or panel area 46. As will be apparent from FIGS. 9 and 10, the closure cap 66 will be formed With an end panel 68 Which is generally flat at least in the central portion thereof. The separately formed button or panel portion 66 will be seated on the end panel 68 and peripherally bonded thereto as at 70 to effect a flexing of the end panel 68.

In that the button or panel area 66 will be of the same configuration as the button or panel area 46, the same reference numeral will be utilized and no further description of the specific configuration thereof is believed to be necessary.

At this time it is pointed out that it is also feasible to form the inverted button or panel area 66 as separate and apart from the end panel in the same manner as shown in FIGS. 8-10.

DESCRIPTION OF ANOTHER EMBODIMENT OF THE INVENTION

Figure 11:
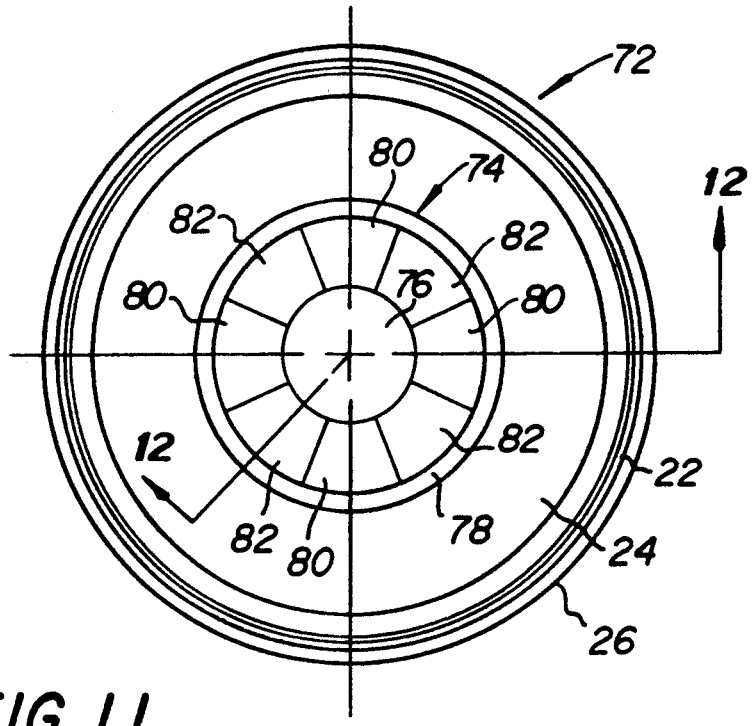
FIG. 11 is a top plan view of a modified form of closure cap showing a different type of faceted energy enhancement arrangement.

Reference is now made to FIG. 11 wherein there is illustrated yet another form of closure cap which incorporates the high energy benefits of a faceted arrangement. The closure cap of FIG. 11 is generally identified by the numeral 72 and, like the closure cap 20, includes a depending skirt 22, which surrounds the end panel 24 and which skirt 22 terminates in a lower curl 26. Further, the skirt 22 and a peripheral part of the end panel 24 is provided with a lining of suitable sealing compound 28.

The closure cap 72 differs from the closure caps 20 and 44 in the formation of a central button or panel area generally identified by the numeral 74. The button or panel area 74 like the button or panel area 46, for example, includes a central post 76 and an outer narrow annular tilted flange 78. Between the post 76 and the flange 78, the button or panel area 74 is of a faceted construction. This faceted construction includes two sets of facets, facets 80 and facets 82 which are arranged in circumferentially alternating relation.

It will be seen that each of the facets 80, 82 are in the form of a flat area and that the slope of the facets 80 is at an angle A with respect to the plane of the post 76 while the slope of the facets 82 is at an angle B to the plane of the post 76. Angles A and B are different and angle A may be on the order of 4° while angle B is on the order of 5°.

At this time it is pointed out that while the illustrated button or panel area 74 has eight facets, the number of facets can vary. Further, the angles of the facets may also be varied depending upon the results desired.

Figure 12:
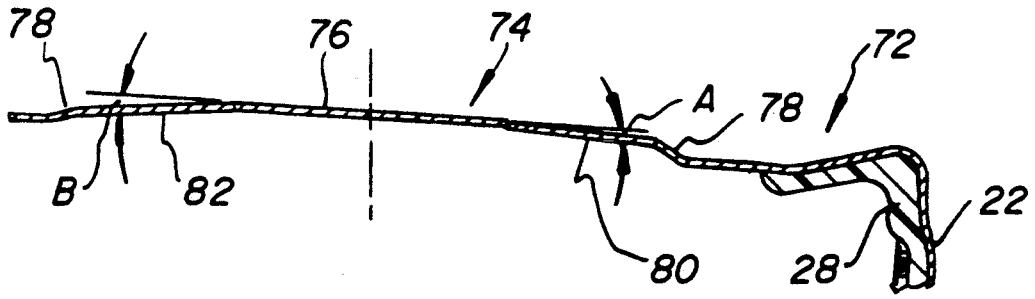
FIG. 12 is an enlarged fragmentary vertical sectional view taken generally along the line 12—12 of FIG. 11 and shows the arrangements of the different facets in a button type arrangement.

From the foregoing, it will be apparent that the closure cap 72 illustrated in FIGS. 11 and 12 is intended to be utilized with a vacuum packed arrangement. On the other hand, a multi faceted button or panel area may be utilized in conjunction with a mechanical actuator. With respect thereto, reference is made to FIG. 13 and the modified closure cap 84 illustrated therein. The closure cap 84 will have an end panel 86 with the central portion thereof being in the form of a recessed button or panel area generally identified by the numeral 88. The button or panel area 88 will be of the same outline and cross section as that of the button or panel area 74 except that it will be inverted from that shown in FIG. 12. Fruther, the outer periphery of the end panel 78 will be provided with a plurality of circumferentially arranged and depending mechanical acutators 90 in the form of buttons which will engage the end sealing surface of a container so as to cause the button or panel area 88 to flip upwardly when the closure cap 84 is applied.

Incidentally, it may be desirable to change the connection between the closure cap 84 and a container neck finish so as to make it of a screw threaded type as opposed to being of a push-on self thread forming type.

Figure 14:
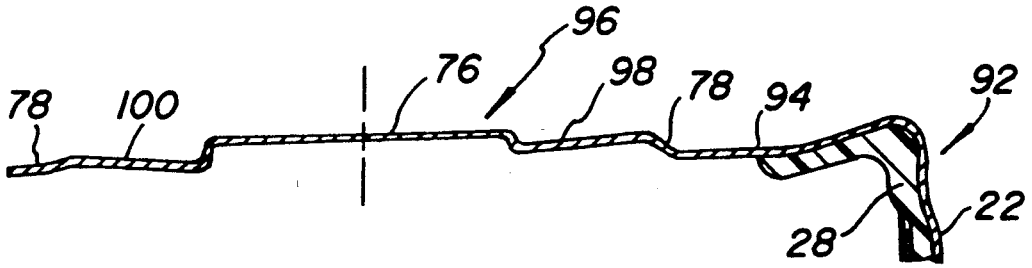
FIG. 14 is another enlarged fragmentary vertical sectional view similar to FIG. 12 and shows a facet arrangement wherein the facets are straight as opposed to tapered.

Reference is next made to yet another modified form of closure cap which is illustrated in FIG. 14 and is generally identified by the numeral 92. The closure cap 92 has a modified form of end panel 94 which includes a slightly modified form of button or panel area generally identified by the numeral 96. The button or panel area 96 will have the same general outline as that of the button or panel area 74, but in lieu of the faceted areas sloping, the button or panel area 96 will include a set of relatively shallow facets 98 which are circumferentially alternated with a set of deeper faceted areas 100, the planes of the faceted areas 98, 100 being substantially parallel to that of the post 76.

Figure 13:
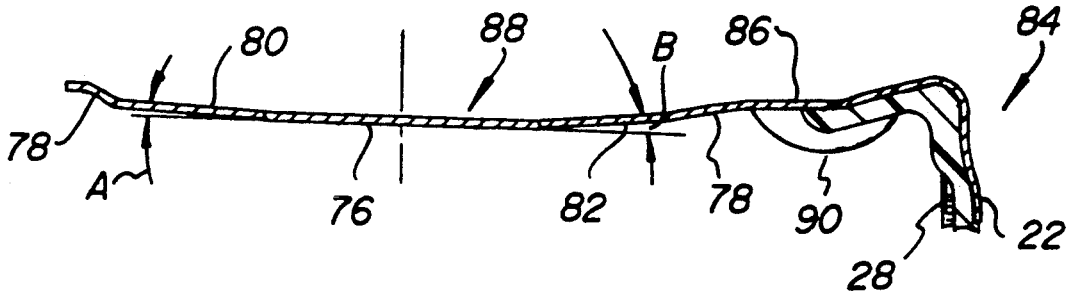
FIG. 13 is an enlarged fragmentary transverse vertical sectional view similar to FIG. 12 but shows the faceted arrangement in an inverted position.

While the button or panel area 96 as illustrated in FIG. 14 is intended to be vacuum actuated, it is to be understood that it may be inverted in the manner generally shown in FIG. 13 so as to be mechanically actuated.

Reference is now made to FIGS. 15 and 16 wherein there is illustrated yet another form of closure cap generally identified by the numeral 102. The closure cap 102 will include a basic cap like that shown in FIGS. 9 and 10 including an end panel 104 with an integral skirt 22 etc. The central part of the end panel 104 will carry a separately formed button or panel portion generally identified by the numeral 106 and having the same outline as the button or panel portion 74 of FIG. 11. The button or panel portion 106 will include a peripheral part 108 which will be suitably bonded to the end panel 104 as at 110.

Those portions of the button or panel portion 106 which are identical to those of the button or panel portion 74 will be identified by like reference numerals.

It is to be understood that with the separately formed button or panel area 106, the end panel 104 of the closure cap 102 will be caused to flip due to either the presence of vacuum within an associated container or the absence of such vacuum.

Further, it is to be understood that closure caps correesponding generally to the closure cap 102 of FIGS. 15 and 16 and having separately formed button or panel areas but incorporating the features of the closure caps 84 and 92 of FIGS. 13 and 14 may be utilized.

Finally, making particular reference to the prior art showing of FIG. 17, it is to be understood that the closure cap arrangements of FIGS. 3-16 may be incorporated in closure cap arrangements having irreversible tamper indicating arrangements such as that broadly disclosed in FIG. 17.

Although a number of preferred embodiments of the high energy closure cap arrangements have been specifically illustrated and described herein, it is to be understood that other minor variations may be made in the high energy closure cap arrangements without departing from the spirit and scope of the invention as defined by the appended claims.

We claim:

1. In a closure cap for vacuum packed containers, said closure including a metal end panel which is axially movable from a vacuum indicating position to a non-vacuum indicating position, the improvement wherein said end panel includes a centrally located generally planar portion which extends radially outwardly into an annular portion, said annular portion including a plurality of circumferentially spaced faceted regions.

2. An end panel according to claim 1 wherein said annular panel portion is an integrally formed part of said end panel.

3. An end panel according to claim 1 wherein said annular panel portion is separately formed part secured to said end panel.

4. An end panel according to claim 3 wherein said annular panel portion is part of a separate panel member of a typical upstanding button profile, and annular panel portion include said faceted regions being downwardly offset from said typical button profile.

5. An end panel according to claim 3 wherein said faceted regions are first faceted regions separated by second faceted regions.

6. An end panel according to claim 5 wherein said second faceted regions differ in slope from said first faceted regions.

7. An end panel according to claim 5 wherein said second faceted regions differ in slope from said first faceted regions, and said slope is radially outwardly and downward.

8. An end panel according to claim 5 wherein said second faceted regions differ in slope from said first faceted regions, and said slope is radially outwardly and upward.

9. An end panel according to claim 1 wherein said faceted regions are separated by regions of normal end panel profile.

10. An end panel according to claim 1 wherein said faceted regions are first faceted regions separated by second faceted regions.

11. An end panel according to claim 10 wherein said second faceted regions differ in slope from said first faceted regions.

12. An end panel according to claim 10 wherein said second faceted regions differ in slope from said first faceted regions, and said slope is radially outwardly and downward.

13. An end panel according to claim 12 wherein said end panel including said annular panel portion is vacuum actuated from an upstanding position to a recessed container closing identifying position.

14. An end panel according to claim 10 wherein said second faceted regions differ in slope from said first faceted regions, and said slope is radially outwardly and upward.

15. An end panel according to claim 14 wherein said end panel is of a typical upstanding button profile, and annular panel portion including said faceted regions being downwardly offset from said typical button profile, and flip energy of said end panel with said faceted regions has been increased on the order of sixfold as compared to that of said typical button profile.

16. An end panel according to claim 10 wherein said second faceted regions differ in axial offset from said first faceted regions.

17. An end panel according to claim 1 wherein said end panel including said annular panel portion is vacuum actuated from an upstanding position to a recessed container closing identifying position.

18. An end panel according to claim 1 wherein said end panel is of a typical upstanding button profile, and annular panel portion includes said faceted regions being downwardly offset from said typical button profile.

19. An end panel according to claim 1 wherein said end panel is of a typical upstanding button profile, and annular panel portion include said faceted regions being downwardly offset from said typical button profile, and flip energy of said end panel with said faceted regions has been increased on the order of sixfold as compared to that of said typical button profile.

20. In a closure cap for vacuum packed containers, said closure including a metal end panel which is axially movable from a generally inwardly deflected vacuum-indicating position to a generally outwardly-deflected non-vacuum indicating position, the improvement wherein said end panel includes a centrally located post portion which extends radially outwardly into a surrounding annular portion of substantially uniform thickness throughout, said annular portion including a plurality of circumferentially spaced faceted regions, each of said faceted regions having a first arcuate width adjacent said post portion and a second arcuate width adjacent the outer most radial extent thereof.

21. The closure cap of claim 20 wherein said first arcuate width of each of said faceted regions is greater than the second arcuate width thereof.

22. The closure cap of claim 20 wherein said first arcuate width of each of said faceted regions is less than the second arcuate width thereof.

23. The closure cap of claim 20 wherein said annular panel portion is an integrally formed part of said end panel.

24. The closure cap of claim 20 wherein said faceted regions are separated by regions of normal end panel profile.

25. The closure cap of claim 20 wherein the faceted regions in said annular portion include first faceted regions which are separated by second faceted regions.

26. The closure cap of claim 25 wherein said second faceted regions differ in slope from said first faceted regions.

27. The closure cap of claim 25 wherein said second faceted regions differ in slope from said first faceted regions, and said slope is radially outwardly and downward.

28. The closure cap of claim 25 wherein said second faceted regions differ in slope from said first faceted regions, and said slope is radially outwardly and upward.

29. The closure cap of claim 28 wherein said end panel is of a typical upstanding button profile, and said annular portion including said faceted region is downwardly offset from said typical button profile, and the flip energy of said end panel with said faceted regions is increased on the order of sixfold as compared to that of said typical button profile.

30. The closure cap of claim 25 wherein said second faceted regions differ in axial offset from said first faceted regions.

31. The closure cap of claim 20 wherein said end panel is of a typically upstanding button profile, and said faceted regions of said annular portion are downwardly offset from said typical button profile.

32. The closure cap of claim 20 wherein said end panel is of a typical upstanding button profile, and said faceted regions of said annular portion are downwardly offset from said typical button profile, and the flip energy of said end panel with said faceted regions is increased on the order of at least sixfold as compared to that of a typical button profile.

* * * * *